US006048290A

United States Patent [19]

Chen et al.

[11] Patent Number: 6,048,290

[45] Date of Patent: Apr. 11, 2000

[54] BABY WALKER

[75] Inventors: Er-Jui Chen, Kaohsiung; Pai-Yu Chang, Yunlin Hsien, both of Taiwan

[73] Assignee: Link Treasure Limited, Tortola, Virgin Islands (Br.)

[21] Appl. No.: 09/192,291

[22] Filed: Nov. 16, 1998

[51] Int. Cl.[7] ..... A63B 22/20; A47D 13/04

[52] U.S. Cl. ..... 482/68; 472/15; 280/87.051; 297/5; 297/137; 297/344.24

[58] Field of Search ..... 482/51, 66–69, 482/78, 143; 434/255, 247; 280/87.051, 87.041; 297/137, 5, 344.26, 344.21, 344.24; 472/14, 15

[56] References Cited

U.S. PATENT DOCUMENTS

| | | | |
|---|---|---|---|
| 368,477 | 8/1887 | Lane et al. | 482/68 |
| 592,569 | 10/1897 | Lehmann | 482/68 |
| 1,475,442 | 11/1923 | Manger | 482/68 |
| 2,308,626 | 1/1943 | Reinholz | 472/15 |
| 2,352,450 | 6/1944 | Reinholz | 472/15 |
| 2,746,517 | 5/1956 | Dahlberg | 472/15 |
| 2,890,741 | 6/1959 | Reinholz | 472/15 |
| 3,730,587 | 5/1973 | Bloxman et al. | 482/69 |
| 5,356,196 | 10/1994 | Chuang | 482/68 |
| 5,409,246 | 4/1995 | Ali | 280/87.051 |
| 5,409,437 | 4/1995 | Lauro et al. | 482/66 |
| 5,433,682 | 7/1995 | Fermaglich et al. | 482/66 |
| 5,590,892 | 1/1997 | Hu | 482/66 |
| 5,727,800 | 3/1998 | Liu | 280/87.051 |
| 5,833,316 | 11/1998 | Hsieh | 297/344.21 |

*Primary Examiner*—Richard J. Apley
*Assistant Examiner*—Victor K. Hwang
*Attorney, Agent, or Firm*—Bacon & Thomas, PLLC

[57] ABSTRACT

A baby walker includes a lower support column swivelably mounted on a base, a curved support bar including a mediate portion secured to the lower support column, two wheels each rotatably mounted on a respective end portion of the curved bar, an upper support column adjustably secured to the lower support column, a top shelf secured to the upper end portion of the upper support column and containing a through hole in the mediate portion thereof, and a seat assembly swivelably mounted in the through hole.

18 Claims, 7 Drawing Sheets

BABY WALKER

CROSS-REFERENCES TO RELATED APPLICATIONS

Not applicable.

BACKGROUND OF THE INVENTION

1. Field of the Invention

The present invention relates to a baby walker.

2. Description of the Related Art

A conventional baby walker comprises a fixed disk fixedly supported on the ground, a support rack swivelably mounted on the fixed disk, an annular backrest mounted on the support rack for placing a baby therein, and a bearing mounted between the fixed disk and the support rack such that the support rack can be freely swiveled relative to the fixed disk. In such a manner, the baby placed in the backrest can swivel around the fixed disk to practice walking in a limited zone. However, the backrest cannot be swiveled relative to the support rack, thereby easily limiting the baby's free movement and decreasing the versatility of the baby walker. The present invention has arisen to mitigate and/or obviate the disadvantage of the conventional baby walker.

BRIEF SUMMARY OF THE INVENTION

In accordance with one aspect of the present invention, there is provided a baby walker comprising a lower support column swivelably mounted on a base, a curved support bar including a mediate portion secured to the lower support column, two wheels each rotatably mounted on a respective end portion of the curved bar, an upper support column adjustably secured to the lower support column, a top shelf secured to the upper end portion of the upper support column and containing a through hole in the mediate portion thereof, and a seat assembly swivelably mounted in the through hole.

Further benefits and advantages of the present invention will become apparent after a careful reading of the detailed description with appropriate reference to the accompanying drawings.

DETAILED DESCRIPTION OF THE INVENTION

Figure 1:
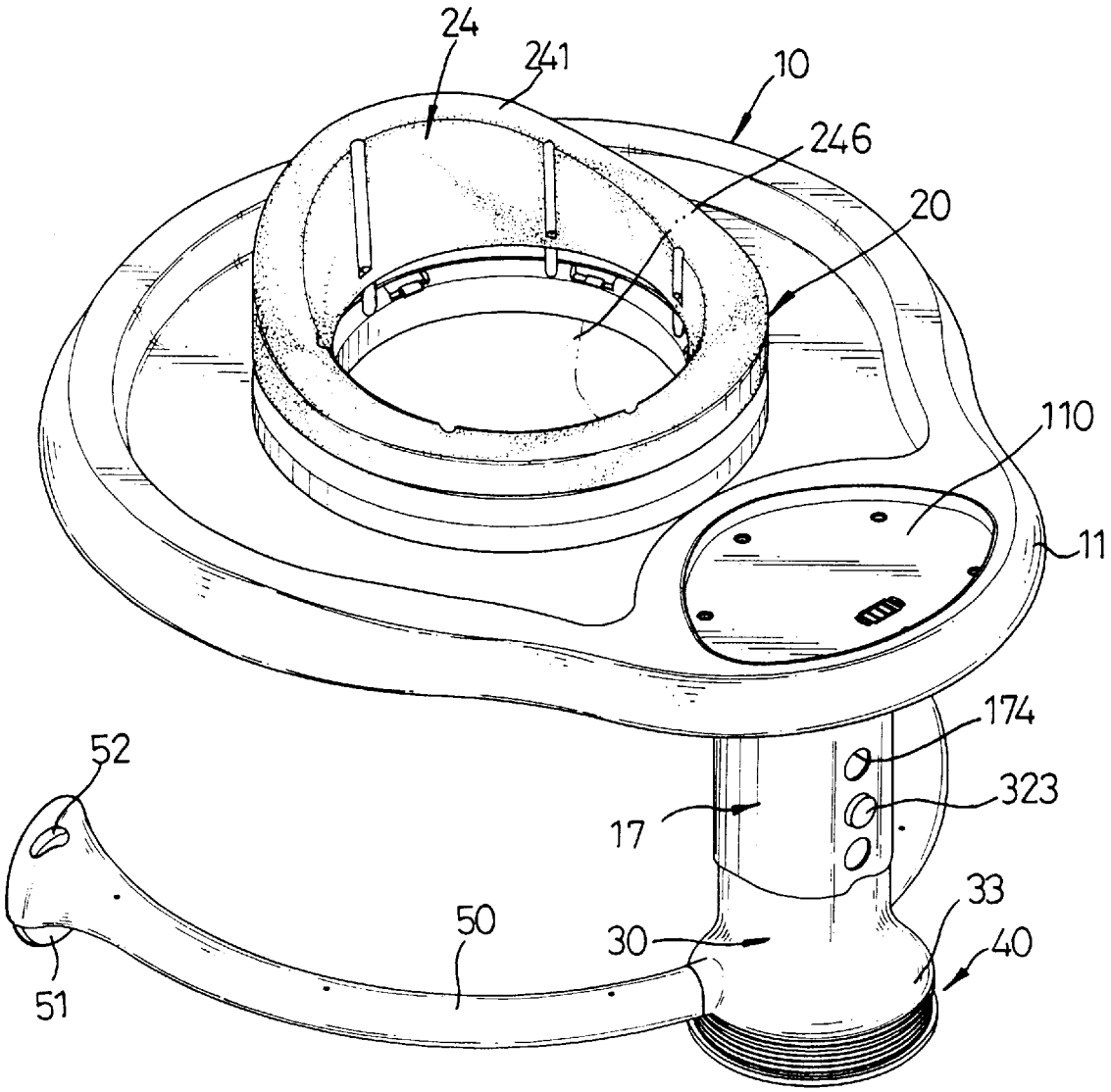
FIG. 1 is a perspective view of a baby walker in accordance with the present invention.

Referring now to the drawings and initially to FIGS. 1–4, a baby walker in accordance with the present invention comprises an annular base (40), a lower support column (30) swivelably mounted on the base (40), a curved support bar (34) including a mediate portion secured to the lower support column (30) and two end portions, two wheels (51) each rotatably mounted on a corresponding end portion of the curved bar (34), an upper support column (17) adjustably secured to the lower support column (30), a top shelf (10) secured to the upper end portion of the upper support column (17) and containing a through hole (12) in the mediate portion thereof, and a seat assembly (20) swivelably mounted in the through hole (12).

The seat assembly (20) further includes an upper rotary ring (22) rotatably mounted on the top of the top shelf (10), an annular backrest (24) secured to the top of the upper rotary ring (22) and having a bevel portion (241), a seat (246) attached to the bottom of the backrest (24) for supporting a baby (not shown) placed in the opening (240) contained in the backrest (24), and a lower rotary ring (23) mounted on the bottom of the top shelf (10) and secured to the upper rotary ring (22) to rotate therewith.

The upper rotary ring (22) contains a plurality of recesses (222) formed in the inner wall thereof each having a locking catch (223), and the lower rotary ring (23) includes an annular lug (232) received in the through hole (12) and having a plurality of hooks (233) each received in the respective recess (222) and each secured by the locking catch (223), thereby securing the lower rotary ring (23) to the upper rotary ring (22).

The upper rotary ring (22) includes a plurality of stubs (225) formed on the inner wall thereof each containing a threaded bore (226), the backrest (24) contains a plurality of cavities (242) formed in the inner wall thereof each aligning with a respective threaded bore (226), and the seat assembly (20) further includes a plurality of locking screws (245) each extending through the respective cavity (242) and screwed into the threaded bore (226), thereby securing the backrest (24) to the upper rotary ring (22).

The top shelf (10) includes an annular flange (13) formed in the through hole (12) and containing a first annular groove (130) in the top thereof, the upper rotary ring (22) contains a second annular groove (221) formed in the bottom thereof, and the seat assembly (20) further includes a bearing (25) mounted between the first annular groove (130) and the second annular groove (221). The bearing (25) includes a plurality of curved bars (26) each slidably received in the first groove (130), and a plurality of balls (27) each mounted between the two respective curved bars (26) and each received between the first annular groove (130) and the second annular groove (221).

The top shelf (10) further includes a distal end portion (11) located distal to the through hole (12) and containing a concave dish (110) for placing articles such as a tiny baby toy, the upper support column (17) is securely fitted to the bottom of the distal end portion (11) of the top shelf (10) and includes two sleeves (171) fixedly mounted in the inner wall thereof, and the baby walker further comprises two bending rods (16) each including an upper portion (162) secured to the bottom of the top shelf (10) and a lower portion (164) fitted into the respective sleeve (171). The top shelf(10) further contains two locking recesses (15) each formed in the bottom thereof, and the upper portion (162) of each of the two bending rods (16) includes two locking pieces (163) extending outward and pressing the wall of the respective locking recess (15).

The upper support column (17) contains a plurality of adjusting holes (174) transversely formed therein, and the lower support column (30) includes a crossbar (32) extending inward from the upper portion thereof and containing a chamber (320) aligning with one of the adjusting holes (174), a push button (323) slidably received in the chamber (320) and detachably extending through one of the adjusting holes (174), and a biasing member (322) such as a spring mounted in the chamber (320) and pressed between the wall of the chamber (320) and the push button (323).

The push button (323) includes a curved surface (325) extending outward from the adjusting hole (174). The crossbar (32) contains a retaining slot (321) open to the chamber (320), and the push button (323) includes a boss (324) slidably received in the retaining slot (321).

The upper support column (17) further contains an elongate guide track (173) longitudinally formed in the inner wall thereof, and the lower support column (30) includes an elongate rib (312) formed on the outer wall thereof and slidably received in the guide track (173).

The lower support column (30) includes two retaining tubes (311) fixedly mounted in the inner wall thereof, and the curved support bar (34) includes two upright rods (341) extending upward from the mediate portion thereof each fitted into the respective retaining tube (311). The lower support column (30) further includes an enlarged lower portion (33) having two sides each containing a curved portion (331) for receiving the support bar (34) therein.

Figure 7:
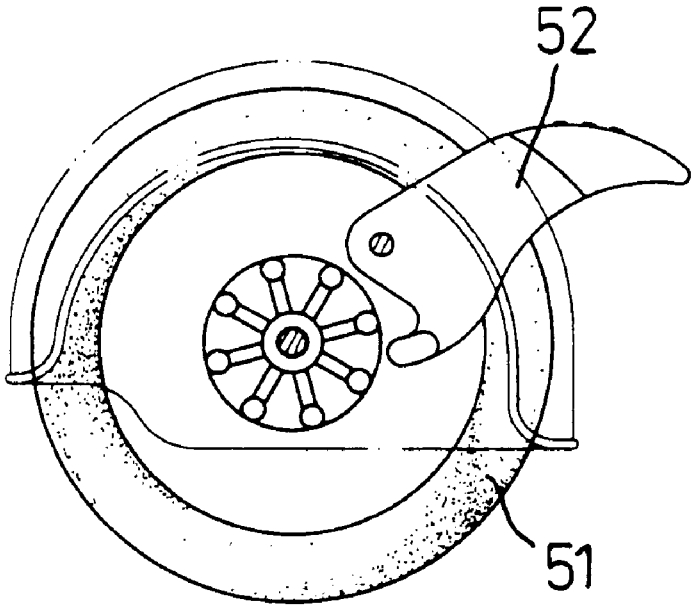
FIG. 7 is a front plan view of a brake pad in conjunction with a wheel of the baby walker.
Figure 8:
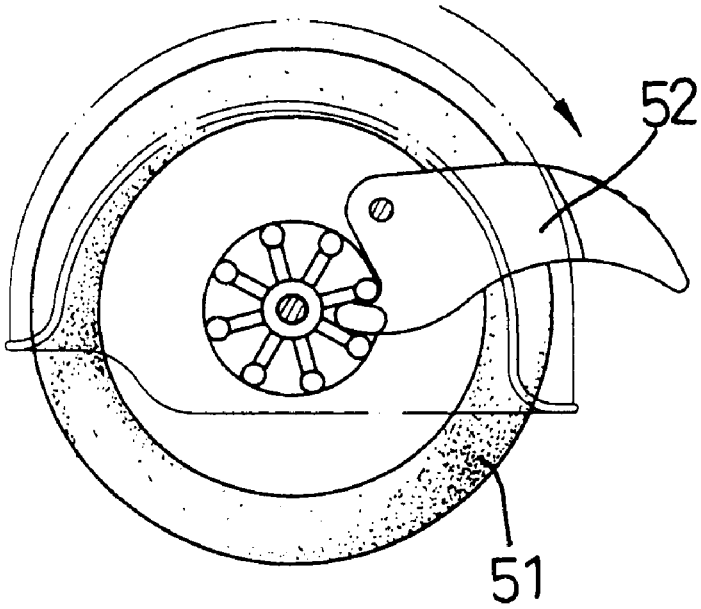
FIG. 8 is an operational view of FIG. 7.

The baby walker further comprises two curved covers (50) each fitted on the respective end portion of the support bar (34), and each of the two wheels (51) is rotatably attached to the respective cover (50). The baby walker further comprises two brakes (52) each pivotally mounted on the respective cover (50) to limit movement of the respective wheel (51) as shown in FIGS. 7 and 8.

The base (40) contains an annular groove (41) formed in the top thereof, and the lower support column (30) further includes an annular flange (333) extending downward from the inner wall of the enlarged lower portion (33) and rotatably received in the annular groove (41). The base (40) further includes a plurality of balls (42) slidably received in the annular groove (41) and each abutting the bottom of the annular flange (333).

The baby walker further comprises a counterweight (43) mounted to the bottom of the base (40), and a circular base plate (44) mounted to the bottom of the counterweight (43).

Figure 2:
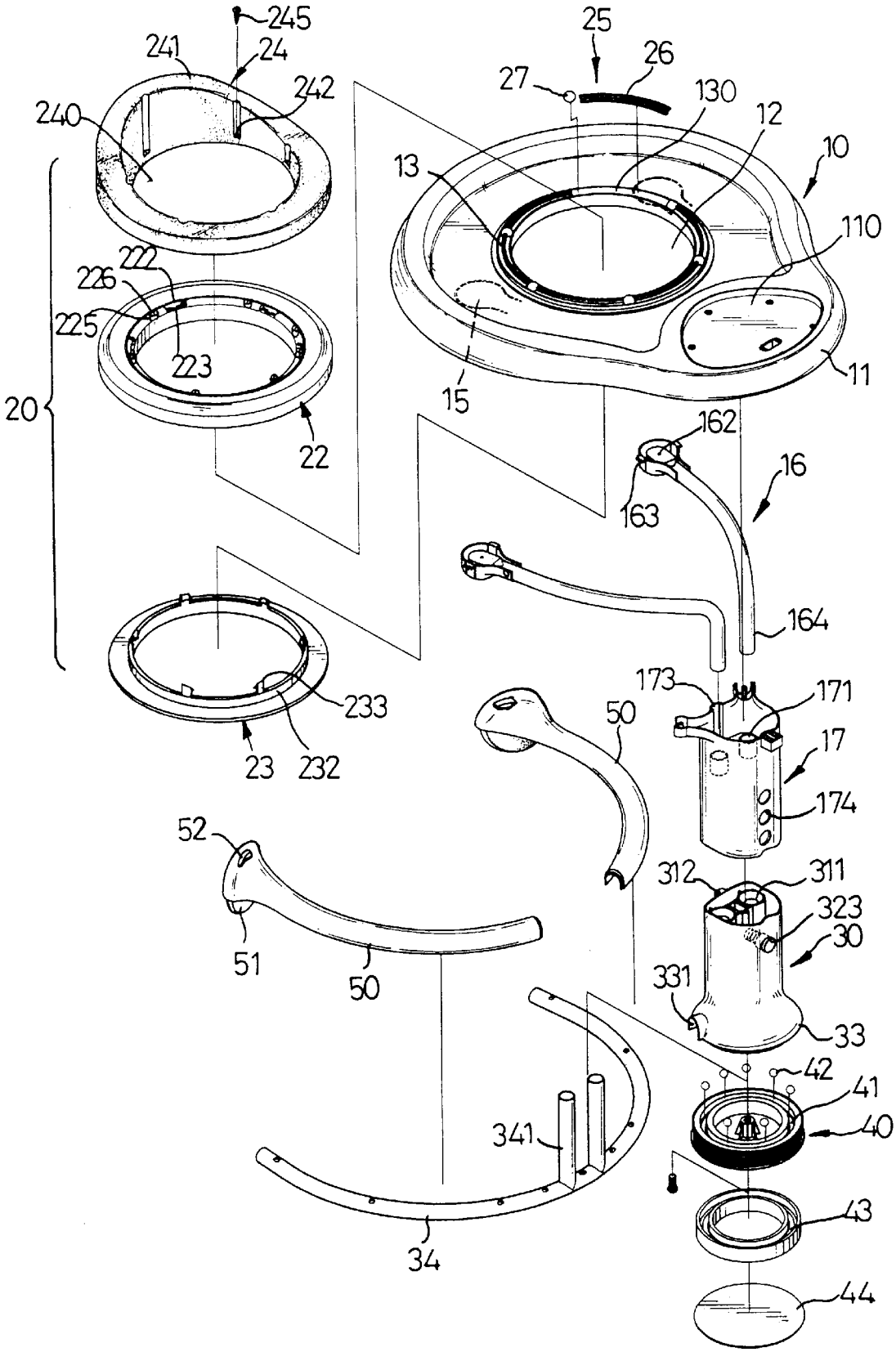
FIG. 2 is a perspective exploded view of the baby walker as shown in FIG. 1.
Figure 3:
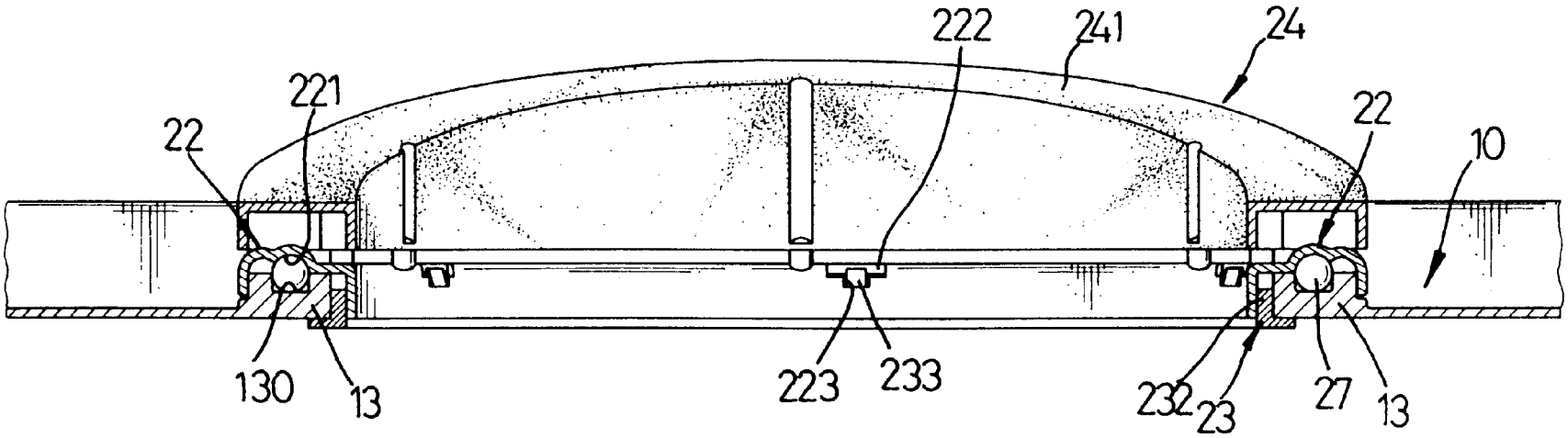
FIG. 3 is a side plan cross-sectional view of the baby walker as shown in FIG. 1.
Figure 4:
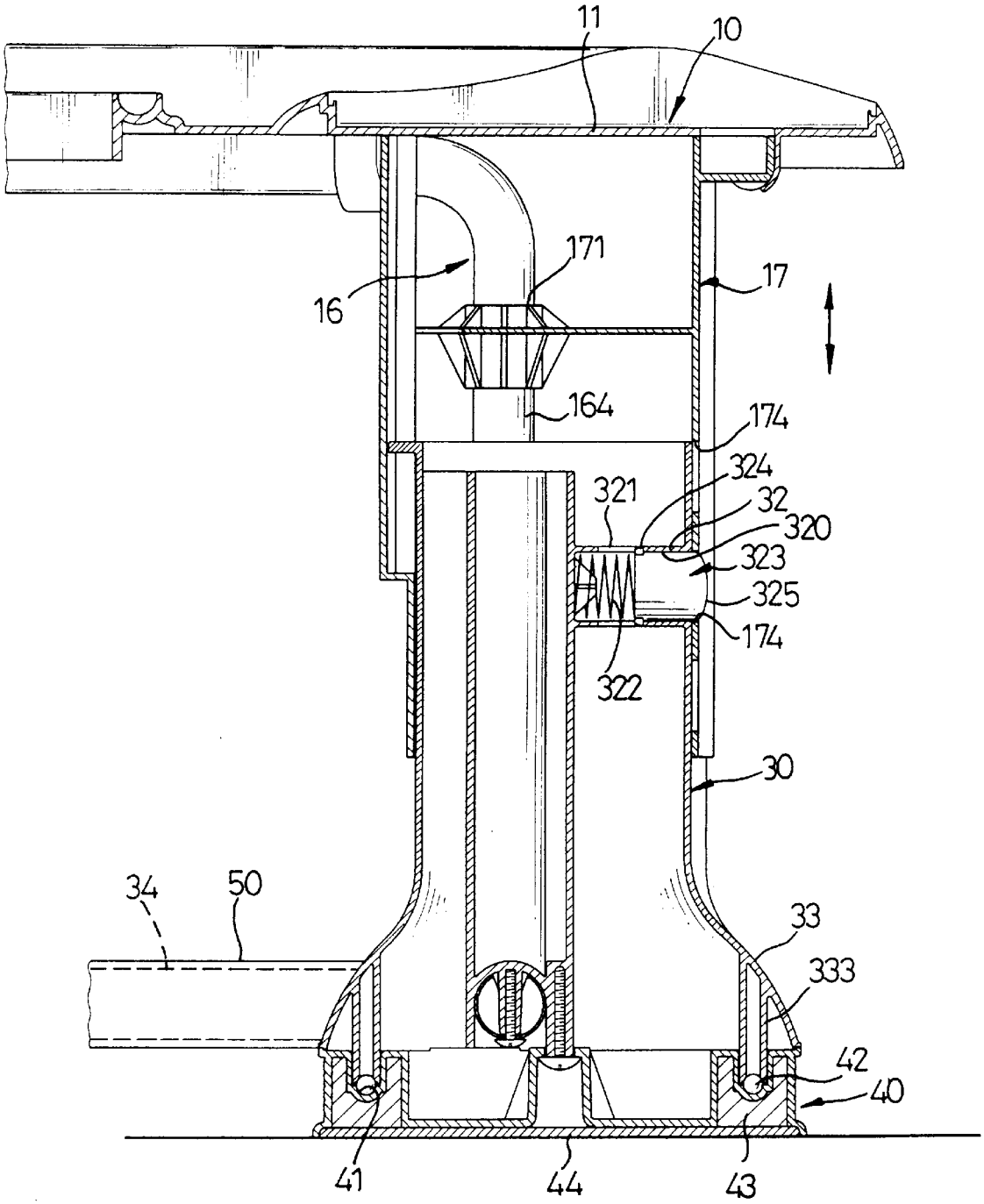
FIG. 4 is a front plan cross-sectional view of the baby walker as shown in FIG. 1.
Figure 5:
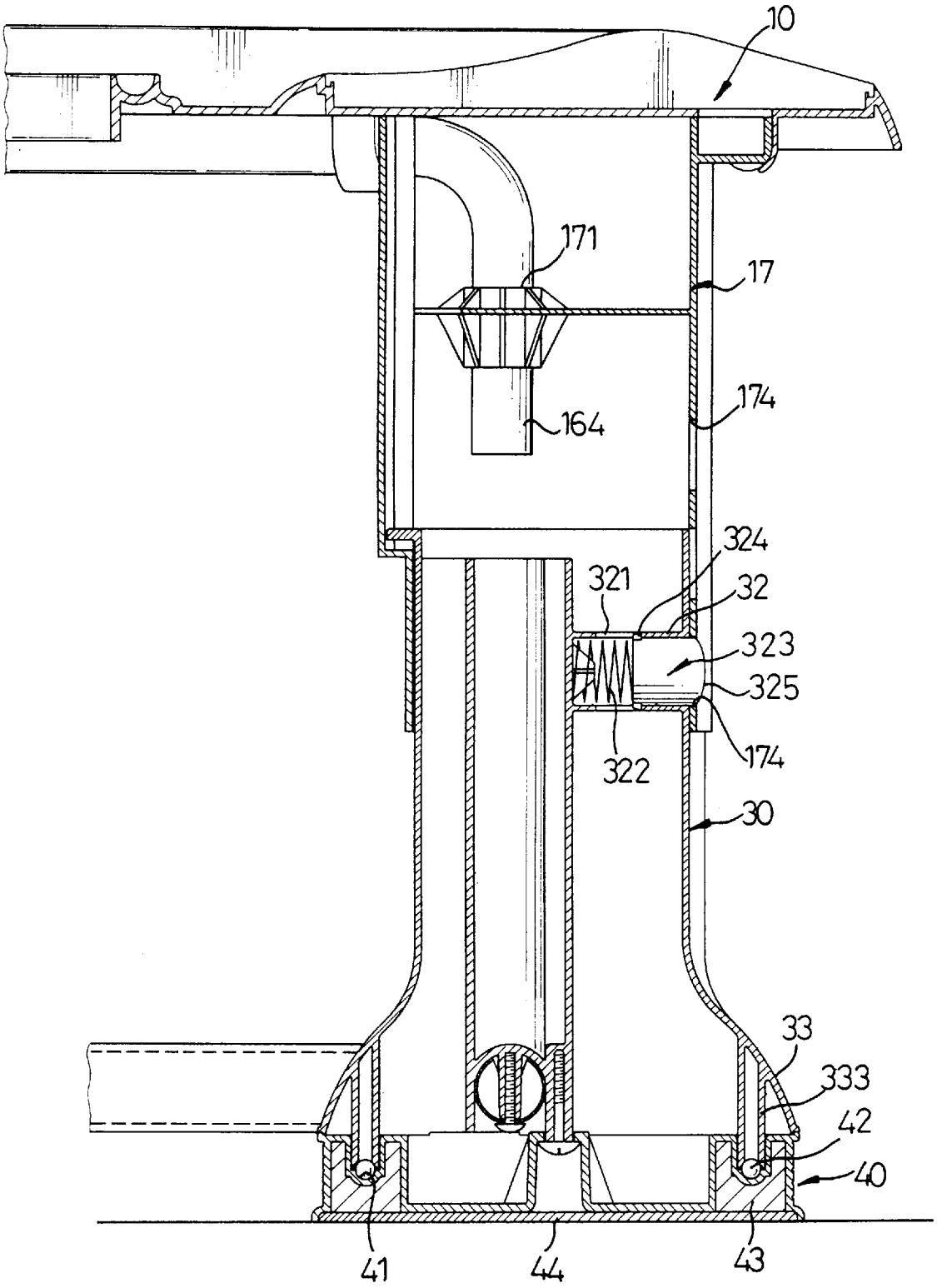
FIG. 5 is an operational view of the baby walker as shown in FIG. 4.

In operation, referring to FIGS. 3 and 4 with reference to FIGS. 1 and 2, the push button (323) is pressed inward to retract into the chamber (320) so as to detach from the adjusting hole (174) such that the upper support column (17) can be moved upward relative to the lower support column (30) from the position as shown in FIG. 4 to the position as shown in FIG. 5, thereby adjusting the height of the baby walker such that the baby walker can be adapted to suit babies of different heights. The push button (323) is pushed to be inserted into another adjusting hole (174) by means of the action the biasing member (322).

Referring now to FIGS. 1–3, the backrest (24) is able to freely swivel relative to the top shelf (10) by means of rotating the upper rotary ring (22) on the annular flange (13) via the bearing (25) such that the baby placed in the backrest (24) can swivel freely relative to the top shelf (10), thereby increasing the baby's interesting so as to remain in the backrest (24) of the baby walker.

Figure 6:
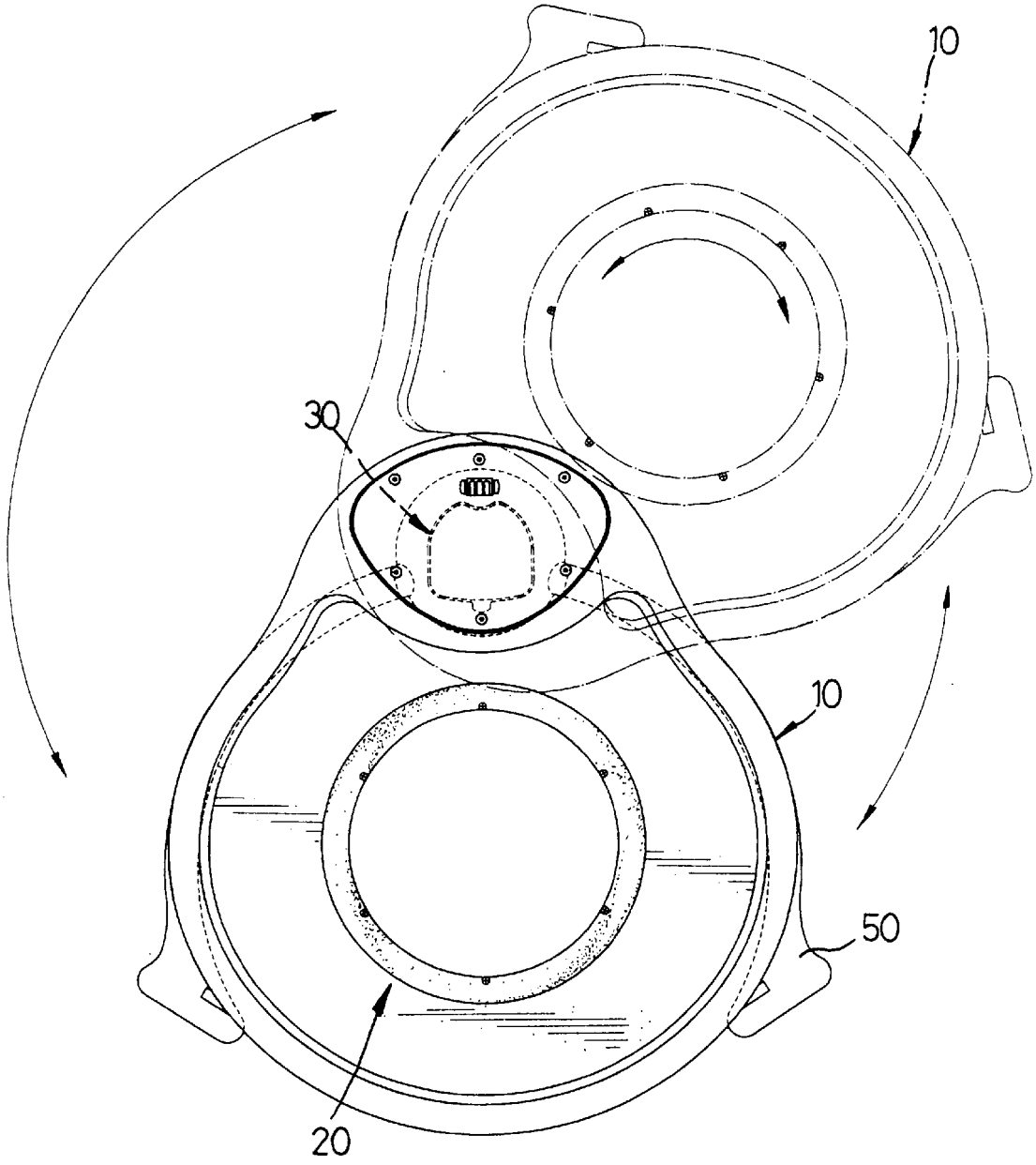
FIG. 6 is a top plan operational view of the baby walker as shown in FIG. 1.

Referring now to FIG. 6 with reference to FIGS. 1–4, the base (40) is retained on the ground by means of the weight of the counterweight (43). The lower support column (30) together with the upper support column (17) is able to swivel relative to the base (40) by means of rotating the annular flange (333) in the annular groove (41) via the balls (42) such that the top shelf (10) can be swiveled relative to the base (40) from the position as shown in solid lines to the position as shown in phantom lines. In such a manner, the top shelf (10) can be freely swiveled relative to the base (40), thereby increasing the versatility of the baby walker.

It should be clear to those skilled in the art that further embodiments may be made without departing from the scope and spirit of the present invention.

What is claimed is:

1. A baby walker comprising:

a base (40);

a lower support column (30) swivelably mounted on said base (40);

a curved support bar (34) including a mediate portion secured to said lower support column (30), and two end portions;

two wheels (51) each rotatably mounted on a corresponding end portion of said curved bar (34);

an upper support column (17) adjustably secured to said lower support column (30);

a top shelf (10) secured to the upper end portion of said upper support column (17) and containing a through hole (12) in the mediate portion thereof; and a seat assembly (20) swivelably mounted in said through hole (12).

2. The baby walker in accordance with claim 1, wherein said seat assembly (20) includes an upper rotary ring (22) rotatably mounted on the top of said top shelf (10), an annular backrest (24) secured to the top of said upper rotary ring (22), and a lower rotary ring (23) mounted on the bottom of said top shelf (10) and secured to said upper rotary ring (22) to rotate therewith.

3. The baby walker in accordance with claim 2, wherein said upper rotary ring (22) contains a plurality of recesses (222) formed in the inner wall thereof each having a locking catch (223), and said lower rotary ring (23) includes an annular lug (232) received in said through hole (12) and having a plurality of hooks (233) each received in said respective recess (222) and each secured by said locking catch (223).

4. The baby walker in accordance with claim 2, wherein said upper rotary ring (22) includes a plurality of stubs (225) formed on the inner wall thereof each containing a threaded bore (226), said backrest (24) contains a plurality of cavities (242) formed in the inner wall thereof each aligning with said respective threaded bore (226), and said seat assembly (20) further includes a plurality of locking screws (245) each extending through said respective cavity (242) and each screwed into said threaded bore (226).

5. The baby walker in accordance with claim 2, wherein said top shelf (10) includes an annular flange (13) formed in said through hole (12) and containing a first annular groove (130), said upper rotary ring (22) contains a second annular groove (221) formed in the bottom thereof, and said seat assembly (20) further includes a bearing (25) mounted between said first annular groove (130) and said second annular groove (221).

6. The baby walker in accordance with claim 5, wherein said bearing (25) includes a plurality of curved bars (26) each slidably received in said first groove (130), and a plurality of balls (27) each mounted between said two respective curved bars (26) and each received between said first annular groove (130) and said second annular groove (221).

7. The baby walker in accordance with claim 1, wherein said top shelf (10) includes a distal end portion (11) located distal to said through hole (12), said upper support column (17) is secured to the bottom of said distal end portion (11) of said top shelf (10) and includes two sleeves (171) mounted in the inner wall thereof, and said baby walker further comprises two bending rods (16) each including an upper portion (162) secured to the bottom of said top shelf (10) and a lower portion (164) fitted into said respective sleeve (171).

8. The baby walker in accordance with claim 7, wherein said top shelf (10) contains two locking recesses (15) each formed in the bottom thereof, and said upper portion (162) of each of said two bending rods (16) includes two locking pieces (163) extending outward and pressing the wall of said respective locking recess (15).

9. The baby walker in accordance with claim 1, wherein said upper support column (17) contains a plurality of adjusting holes (174) transversely formed therein, and said lower support column (30) includes a crossbar (32) extending inward from the upper portion thereof and containing a chamber (320) aligning with one of said adjusting holes (174), a push button (323) slidably received in said chamber (320) and detachably extending through one of said adjusting holes (174), and a biasing member (322) mounted in said chamber (320) and pressed between the wall of said chamber (320) and said push button (323).

10. The baby walker in accordance with claim 9, wherein said push button (323) includes a curved surface (325).

11. The baby walker in accordance with claim 9, wherein said crossbar (32) contains a retaining slot (321) open to said chamber (320), and said push button (323) includes a boss (324) slidably received in said retaining slot (321).

12. The baby walker in accordance with claim 1, wherein said upper support column (17) contains an elongate guide track (173) longitudinally formed in the inner wall thereof, and said lower support column (30) includes an elongate rib (312) formed on the outer wall thereof and slidably received in said guide track (173).

13. The baby walker in accordance with claim 1, wherein said lower support column (30) includes two retaining tubes (311) mounted in the inner wall thereof, and said curved support bar (34) includes two upright rods (341) extending upward from the mediate portion thereof each fitted into said respective retaining tube (311).

14. The baby walker in accordance with claim 1, wherein said base (40) contains an annular groove (41) formed in the top thereof, and said lower support column (30) includes an annular flange (333) extending downward from the inner wall thereof and rotatably received in said annular groove (41).

15. The baby walker in accordance with claim 14, wherein said base (40) includes a plurality of balls (42) slidably received in said annular groove (41) and each abutting the bottom of said annular flange (333).

16. The baby walker in accordance with claim 1, further comprising a counterweight (43) mounted to the bottom of said base (40).

17. The baby walker in accordance with claim 16, further comprising a base plate (44) mounted to the bottom of said counterweight (43).

18. The baby walker in accordance with claim 1, further comprising two brake pads (52) each pivotally mounted on the respective end portion of said curved bar (34) to limit movement of said respective wheel (51).

* * * * *